US011401929B2

(12) United States Patent
Stewart et al.

(10) Patent No.: US 11,401,929 B2
(45) Date of Patent: Aug. 2, 2022

(54) SYSTEM AND METHOD FOR MONITORING OPERATIONS OF EQUIPMENT BY SENSING DEFORMITY IN EQUIPMENT HOUSING

(71) Applicant: SPM Oil & Gas Inc., Fort Worth, TX (US)

(72) Inventors: Trevor Dean Stewart, Fort Worth, TX (US); Lloyd Gregory Cox, Dallas, TX (US); Scott Skurdalsvold, Mansfield, TX (US); Bryan Wagner, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 21 days.

(21) Appl. No.: 16/147,719

(22) Filed: Sep. 29, 2018

(65) Prior Publication Data

US 2019/0100989 A1 Apr. 4, 2019

Related U.S. Application Data

(60) Provisional application No. 62/567,114, filed on Oct. 2, 2017.

(51) Int. Cl.
*F04B 53/00* (2006.01)
*F04B 47/00* (2006.01)
(Continued)

(52) U.S. Cl.
CPC ..... *F04B 53/00* (2013.01); *F04B 47/00* (2013.01); *F04B 49/00* (2013.01); *F04B 49/065* (2013.01);
(Continued)

(58) Field of Classification Search
CPC ..... F04B 49/065; F04B 2201/0802; F04B 49/00; F04B 49/06; F04B 53/00; F04B 2201/02071
See application file for complete search history.

(56) References Cited

U.S. PATENT DOCUMENTS 4,467,657 A * 8/1984 Olsson ..... G01F 13/00 377/21
9,915,572 B2 * 3/2018 Teil ..... G06F 1/1626
(Continued)

FOREIGN PATENT DOCUMENTS

CN 204029129 U * 12/2014
WO WO-2018109572 A1 * 6/2018 ..... G07C 3/00

OTHER PUBLICATIONS

International Search Report and Written Opinion received in Patent Cooperation Treaty Application No. PCT/US2018/053668, dated Dec. 4, 2018.

*Primary Examiner* — Justin N Olamit

(57) ABSTRACT

A universal monitoring system applicable to a variety of hydraulic fracturing equipment includes an accelerometer mounted on a housing of a positive displacement pump and configured to sense a vibration associated with the positive displacement pump on start-up and generate a wake-up signal. A processor is communicatively coupled to the accelerometer and configured to initiate execution upon receiving the wake-up signal. A pressure strain gauge is mounted directly on the pump housing and is configured to sense deformity in the pump housing caused by alternating high and low pressures within the pump housing and generate sensor data. The processor is configured to receive the sensor data from the pressure strain gauge and configured to analyze the sensor data and determine a cycle count value for the positive displacement pump, and there is at least one communication interface coupled to the processor configured to transmit the sensor data and cycle count value to another device.

15 Claims, 4 Drawing Sheets

(51) Int. Cl.
*F04B 49/06* (2006.01)
*F04B 49/00* (2006.01)

(52) U.S. Cl.
CPC ..... *F04B 2201/02071* (2013.01); *F04B 2201/0802* (2013.01)

(56) References Cited

U.S. PATENT DOCUMENTS

| | | | | |
|---|---|---|---|---|
| 9,950,112 | B2 * | 4/2018 | Melker | A61M 5/142 |
| 10,584,698 | B2 * | 3/2020 | Haddad | F04B 43/02 |
| 2007/0139211 | A1 | 6/2007 | Pessin et al. | |
| 2008/0006089 | A1 * | 1/2008 | Adnan | F04B 51/00 73/587 |
| 2010/0021314 | A1 * | 1/2010 | Lee | F04B 49/00 417/53 |
| 2014/0262237 | A1 * | 9/2014 | Walton | E21B 47/13 166/250.01 |
| 2016/0356270 | A1 | 12/2016 | Zhang et al. | |

* cited by examiner

SYSTEM AND METHOD FOR MONITORING OPERATIONS OF EQUIPMENT BY SENSING DEFORMITY IN EQUIPMENT HOUSING

RELATED APPLICATION

The present application claims the benefit of U.S. Provisional Patent Application No. 62/567,114 filed on Oct. 2, 2017, incorporated herein by reference.

FIELD

The present disclosure relates to sensors and monitoring devices and systems, and in particular, to a system and method for universal fracturing site equipment monitoring.

BACKGROUND

Hydraulic fracturing is a process to obtain hydrocarbons such as natural gas and petroleum by injecting a fracking fluid or slurry at high pressure into a wellbore to create cracks in deep rock formations. The hydraulic fracturing process employs a variety of different types of equipment at the site of the well, including one or more positive displacement pumps, slurry blender, fracturing fluid tanks, high-pressure flow iron (pipe or conduit), wellhead, valves, charge pumps, and trailers upon which some equipment are carried.

Positive displacement or reciprocating pumps are commonly used in oil fields for high pressure hydrocarbon recovery applications, such as injecting the fracking fluid down the wellbore. A positive displacement pump may include one or more plungers driven by a crankshaft to create a high or low pressure in a fluid chamber. A positive displacement pump typically has two sections, a power end and a fluid end. The power end includes a crankshaft powered by an engine that drives the plungers. The fluid end of the pump includes cylinders into which the plungers operate to draw fluid into the fluid chamber and then forcibly push out at a high pressure to a discharge manifold, which is in fluid communication with a well head.

DETAILED DESCRIPTION

The universal hydraulic fracturing site equipment monitoring system and method may be used on a number of different pieces of equipment commonly found at a hydraulic fracturing site, such as positive displacement pumps, slurry blender, fracturing fluid tanks, high-pressure flow iron (pipe or conduit), charge pump (which is typically a centrifugal pump), trailers upon which some equipment are carried, valves, wellhead, conveyers, and other equipment. It is desirable to monitor the operation of these equipment so that timely inspection, maintenance, and replacement can be scheduled to ensure optimal operations. The universal hydraulic fracturing site monitoring system and method described herein comprise a universal monitoring device that can be used to monitor the operations of these different types of equipment used for hydraulic fracturing. Currently, no reliable data is available relating to the operations of these equipment so that equipment servicing tasks can be scheduled in a timely and optimal manner. Further, operation data can be easily falsified to benefit from warranty programs if no accurate data is available.

Figure 1:
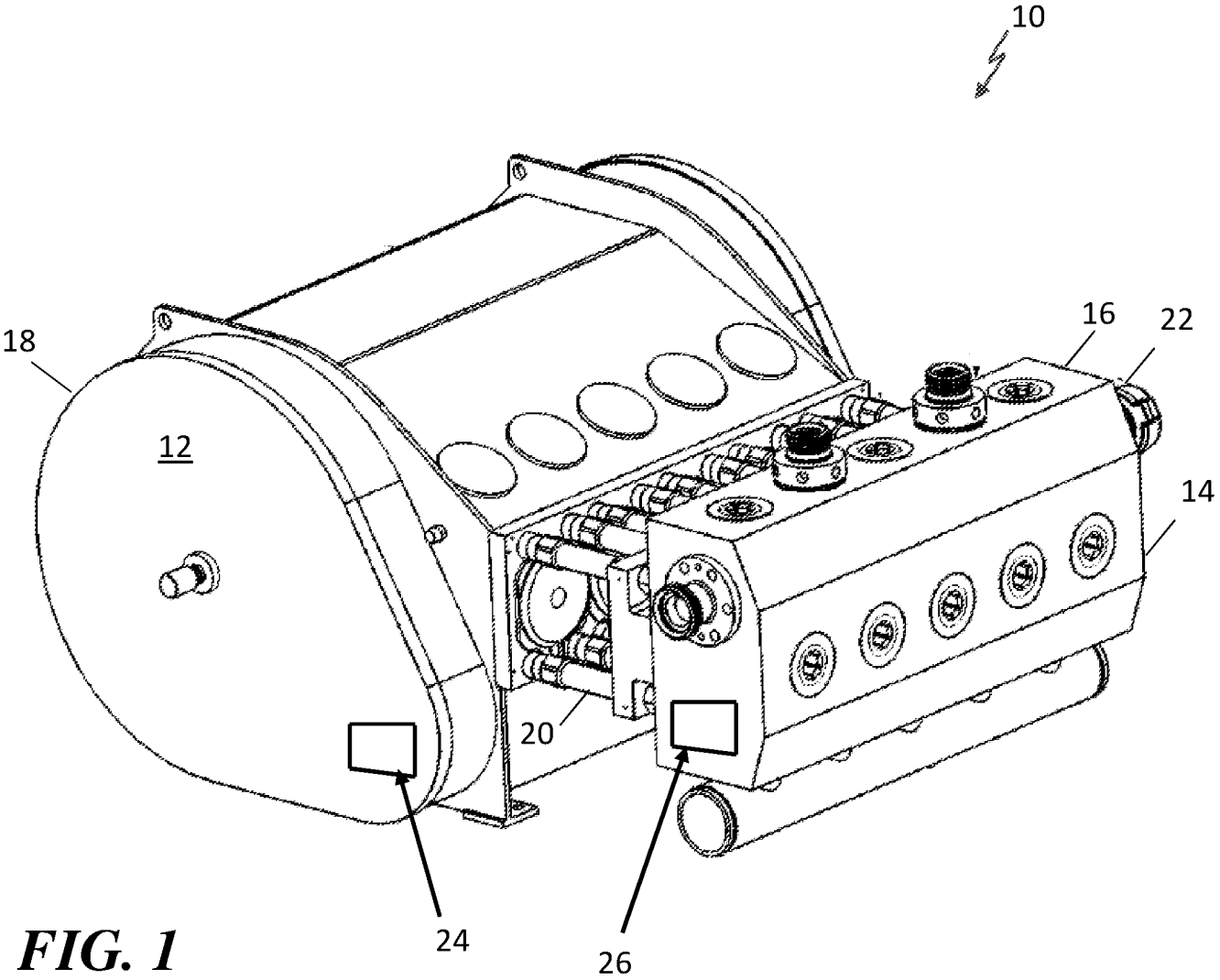
FIG. 1 is a pictorial representation of an exemplary positive displacement pump as an exemplary monitoring subject for a universal monitoring device according to the teachings of the present disclosure.

FIG. 1 is a pictorial representation of an exemplary positive displacement pump as an exemplary monitoring subject for a universal monitoring device according to the teachings of the present disclosure. The positive displacement pump 10 has two sections, a power end 12 and a fluid end 14. The fluid end 14 of the pump includes a fluid end block or fluid cylinder 16, which is connected to the power end housing 18 via a plurality of stay rods 20. In operation, the crankshaft (not explicitly shown) reciprocates a plunger rod assembly between the power end 12 and the fluid end 14. The crankshaft is powered by an engine or motor (not explicitly shown) that drives a series of plungers (not explicitly shown) to create alternating high and low pressures inside a fluid chamber. The cylinders operate to draw fluid into the fluid chamber and then discharge the fluid at a high pressure to a discharge manifold 22. The discharged liquid is then injected at high pressure into an encased wellbore. The injected fracturing fluid is also commonly called a slurry, which is a mixture of water, proppants (silica sand or ceramic), and chemical additives. The pump 10 can also be used to inject a cement mixture down the wellbore for cementing operations. The pump 10 may be freestanding on the ground, mounted to a skid, or mounted to a trailer.

Figure 2:
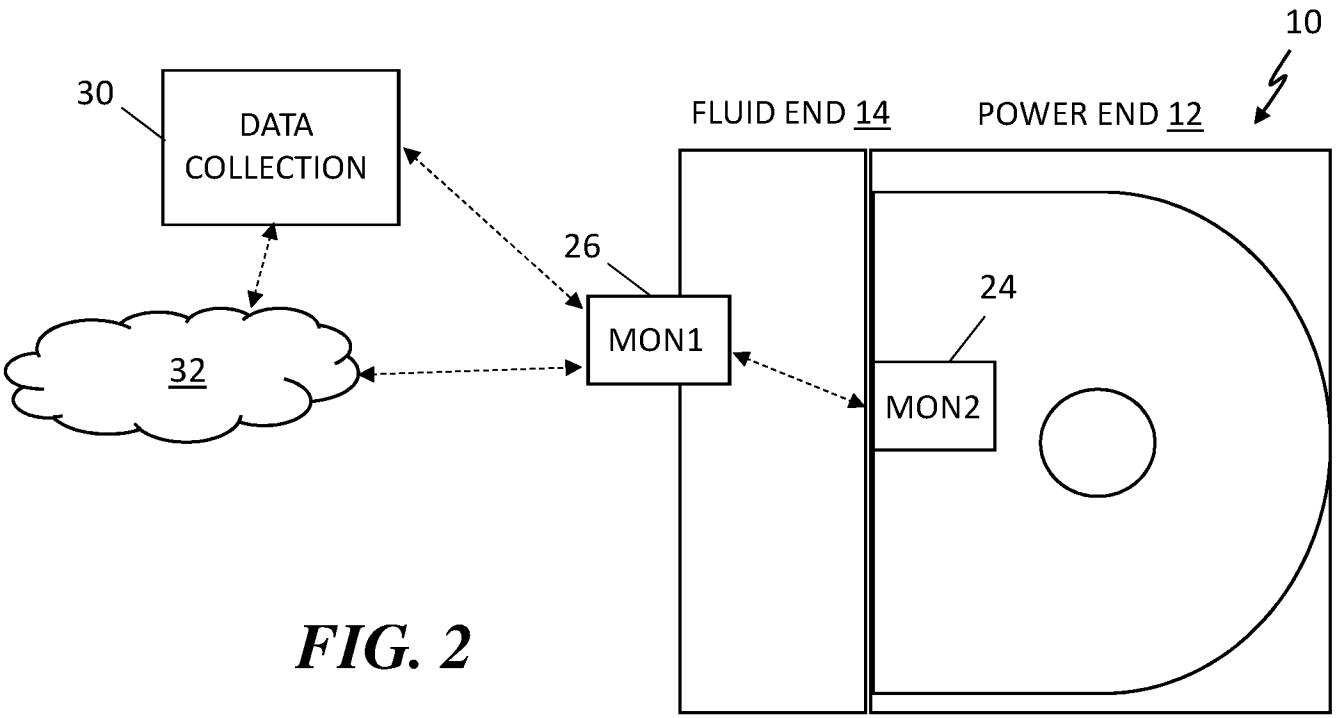
FIG. 2 is a simplified diagrammatical representation of a fluid end and a power end of an exemplary positive displacement pump as an exemplary monitoring subject for a universal monitoring device according to the teachings of the present disclosure.

Also referring to FIG. 2, in a preferred embodiment, the universal monitoring device (22, 24) can be affixed to an exterior surface (such as in a machined pocket or cavity) of the pump housing in the power end 12 and/or the fluid end 14. The power end device 24 and the fluid end device 26 may be identical or different in hardware, firmware, and software (execution logic). Hereinafter the term "universal monitoring device" is used to refer to a monitoring device that includes sensors and data analysis logic that may be affixed, mounted, or incorporated into any portion of a piece of equipment at a frac site according to the teachings of the present disclosure. The universal monitoring device may include one or more sensors that are located entirely outside of the fluid chamber and/or sensors that have components that are in direct contact with the fracturing fluid within the fluid chamber or elsewhere. The power end monitoring device 24 and the fluid end monitoring device 26 may communicate with each other and with other devices, such as a data collection or analysis device 30, and devices coupled to the global computer network (Internet) 32 via a wired or wireless communication protocol now known or to be developed, including WiFi, Bluetooth, ZigBee, Z-Wave, NFC, RFID, IR, or another suitable protocol or technology. The universal monitoring device may also transmit the sensor data and calculated data in real-time as they become available to the remote data analysis module and/or on-site operator's computing device, which may be a mobile telephone, tablet computer, laptop computer, desktop computer, or any suitable computer, for data display, report generation, alert generation, and further analysis.

Figure 3:
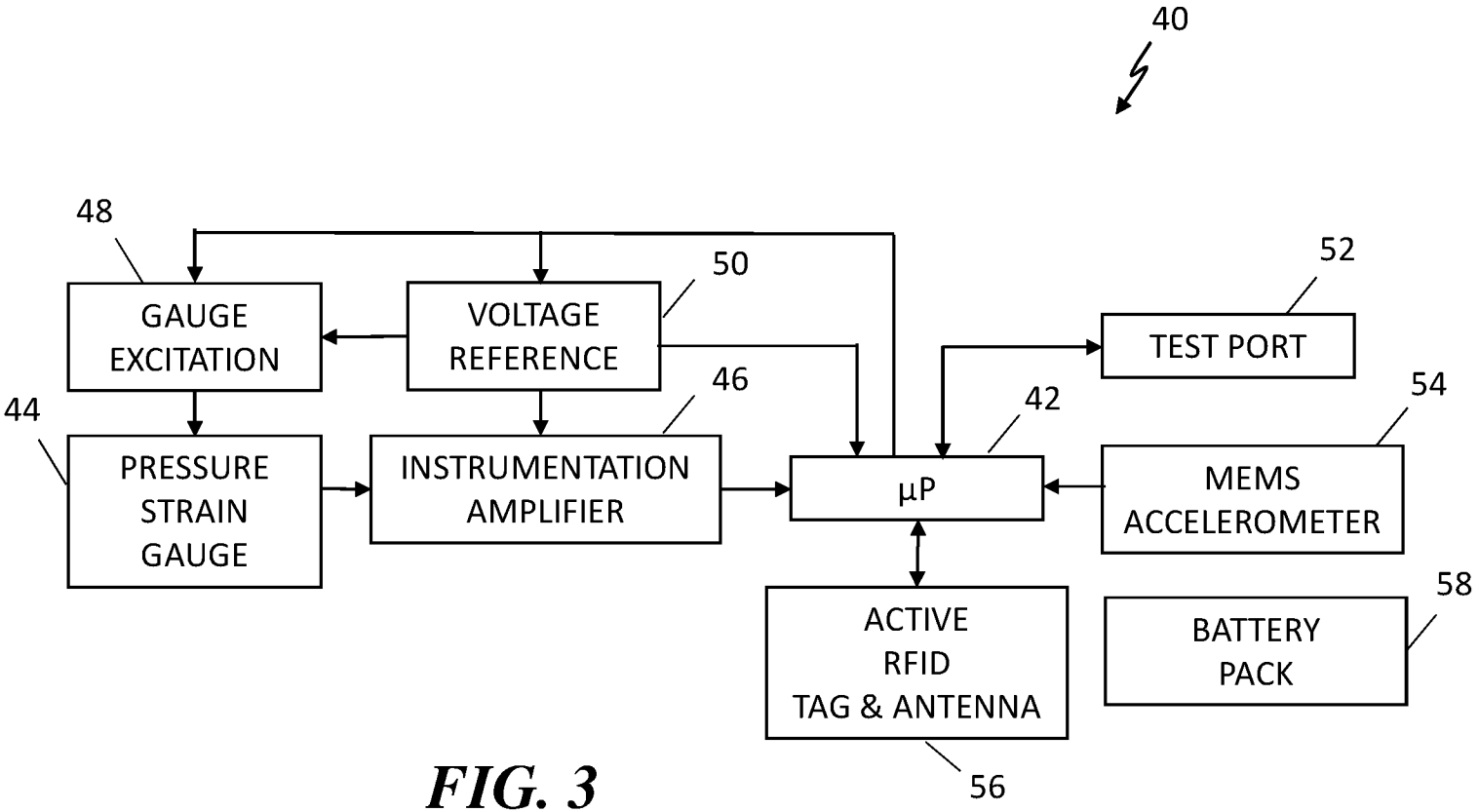
FIG. 3 is a more detailed block diagram of an exemplary embodiment of a system and method of universal fracturing site equipment monitoring according to the teachings of the present disclosure.

FIG. 3 is a block diagram of an exemplary embodiment of a universal monitoring device 40 according to the teachings of a system and method of monitoring the operations of fracturing site equipment. The universal monitoring device 40 includes a microcontroller or microprocessor (μP) 42 (hereinafter referred to as a microcontroller) that is coupled to and receives pressure measurements from a strain gauge 44, via an amplifier 46. The microcontroller may include read-only memory (ROM), random access memory (RAM), ferroelectric RAM, ADC (analog-to-digital converter), DAC (digital-to-analog converter), one or more data communication interfaces such as UART (Universal Asynchronous Receiver-Transmitter), IrDA (Infrared Data Association), and SPI (Serial Peripheral Interface), etc. The strain gauge 44 may be mounted or attached directly to the metal housing of, for example, the fluid end 16 of the pump 10, or is mounted or attached directly to the housing of the universal monitoring device (that is directly mounted to the pump housing), and is sufficiently sensitive to detect deformity in the pump fluid end housing due to the alternating high and low pressures in its fluid chamber and convert it to an electrical resistance measurement. The small voltage output from the strain gauge 44 is augmented by the amplifier 46 before it is provided to the microcontroller 42. The universal monitoring device 40 further includes an optional gauge excitation circuit 48 that functions as a constant current source for the strain gauge 44. A precision voltage reference circuit 50 is configured to supply an accurate temperature-compensated voltage source to the gauge excitation circuit 48. The universal monitoring device 40 may also be equipped with a test port 52, which may be in communication with the UART of the microcontroller 42. The test port 52 may use an optical, e.g., infrared, communication technology. A MEMS (Micro Electro Mechanical System) accelerometer 54 configured to measure static and dynamic accelerations is further coupled to the microcontroller 42. An active RFID tag and accompanying antenna 56 are also coupled to the microcontroller 42. A battery pack 58 is provided to supply operating voltage to all circuits. Except the strain gauge, the circuit components shown in FIG. 3 are mounted on a printed circuit board that is attached to the housing of the equipment, such as the fluid end of a pump.

Figure 4:
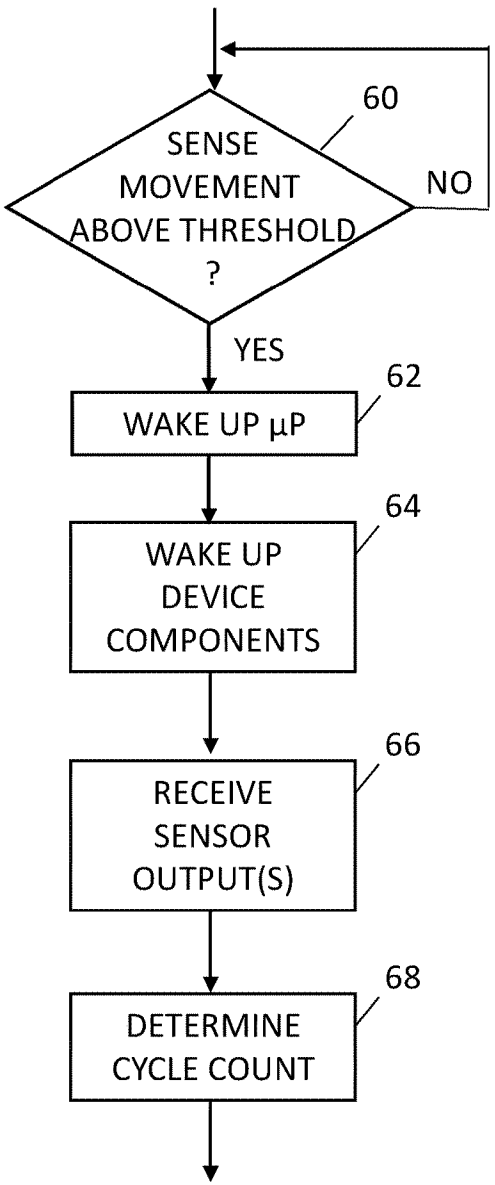
FIG. 4 is a simplified flowchart of an exemplary embodiment of a method of universal fracturing site equipment monitoring according to the teachings of the present disclosure.

Referring to the flowchart in FIG. 4, the accelerometer 54 is capable of detecting motion at start-up which is indicative that the pump has initiated operations. Upon detecting vibrations or motion above a certain threshold (block 60), the accelerometer 54 generates a signal that is provided to the microcontroller 42 to "wake up" the microcontroller 42 (block 62), which powers up and in turn automatically "wakes up" the other circuitry in the universal monitoring device (block 64). This wake-up feature allows the universal monitoring device to be on low-power mode until the pump begins operations. The pressure strain gauge 44 detects the slight deformity in the pump housing (fluid end or power end) and provides this information, i.e., pressure measurements, to the microcontroller 42 via the amplifier 46 (block 66). The microcontroller 42 stores and analyzes this information, and determines one or more pump operating parameters, for example, the number of cycles that the pump has been operating (block 68). Analysis performed by the microcontroller 42 includes collecting the pressure measurements and performs a histogram analysis of the data. The active RFID tag 56 enables personnel to use another RFID device to communicate wirelessly with the universal monitoring device, for example, to download the pressure measurement histogram. The test port 52 may be used to upload firmware program updates, perform calibrations, and data retrieval.

In a preferred embodiment, the universal monitoring device is configured to measure and determine at least one of three primary pump operating parameters that include: 1) cycle count, 2) pump speed, and 3) pump pressure. A number of devices may be incorporated in the universal monitoring device to monitor and measure pump operations that may be used to arrive at these three parameters. Examples include: strain gauge, pressure sensor, accelerometer, vibration sensor, piezoelectric element, proximity sensor, linear variable displacement transducer (LVDT), load cell, and flow meter. The universal monitoring device may include one or more of these sensors/devices. Pressure could also be obtained by using strain gauges or load cells located in close proximity to the bore but not necessarily in direct contact with the frac fluids. As shown in FIG. 3 and described above, a strain gauge may be used to sense deformity in the pump housing to derive a cycle count.

In another embodiment, a fluid pressure sensor may be used within the fluid chamber in the fluid end of the pump to measure the fluid pressure. The fluid pressure sensor may relay measurement fluid pressure data to a processor of the universal monitoring device wirelessly or via a wired connection. The processor includes logic that can determine or calculate at least one of the cycle count, pump speed, and pump pressure parameters of the pump from the fluid pressure data by analysis.

In yet another embodiment, an accelerometer may be incorporated within the universal monitoring device. The accelerometer can be mounted on an exterior surface of the fluid end and/or power end of the pump. The accelerometer is configured to measure or sense the movement or vibrations of the pump and provide this data to a processor of the universal monitoring device. A vibration sensor functions similarly and can also be used for this purpose. The processor includes logic that can determine or calculate at least one of the cycle count, pump speed, and pump pressure parameters of the pump from the accelerometer data or vibration data by analysis.

In yet another embodiment, a piezoelectric element may be incorporated within the universal monitoring device. The piezoelectric element can be mounted on an exterior surface (or internal cavity such as a machined pocket) of the fluid end and/or power end of the pump. The piezoelectric element is configured to generate a voltage in response to applied mechanical stress in the metal housing of the pump under the high pressure of the fluid. The generated voltage can be relayed to a processor of the universal monitoring device. The processor includes logic that can determine or calculate at least one of the cycle count, pump speed, and pump pressure parameters of the pump from the piezoelectric data by analysis.

In yet another embodiment, a proximity sensor may be incorporated within the universal monitoring device. The proximity sensor is configured to generate data in response to detected presence of or movement of a portion of the metal housing of the pump displaced by the high pressure of the fluid. The generated data can be relayed to a processor of the universal monitoring device. The processor includes logic that can determine or calculate at least one of the cycle count, pump speed, and pump pressure parameters of the pump from the proximity sensor data by analysis.

In yet another embodiment, a linear variable displacement transducer (LVDT) may be incorporated within the universal monitoring device. The LVDT can be mounted on an exterior surface of the fluid end and/or power end of the pump. The LVDT is configured to measure the minute displacement of the pump housing under the high pressure of the fluid. The sensed value can be relayed to a processor of the universal monitoring device. The processor includes logic that can determine or calculate at least one of the cycle count, pump speed, and pump pressure parameters of the pump from the LVDT data by analysis.

In yet another embodiment, a load cell may be incorporated within the universal monitoring device. The load cell can be mounted on an exterior surface (or internally such as a machined cavity or pocket) of the fluid end and/or power end of the pump. The load cell is configured to measure the outward displacement of the pump housing against the load cell under the high pressure of the fluid. The sensed value can be relayed to a processor of the universal monitoring device. The processor includes logic that can determine or calculate at least one of the cycle count, pump speed, and pump pressure parameters of the pump from the load cell data by analysis.

The universal monitoring device may be used to monitor a variety of equipment at a fracturing site. The universal monitoring device may be used to monitor the operations of a positive displacement pump, a slurry blender, fracturing fluid tanks, high-pressure flow iron (pipe or conduit), trailers upon which some equipment are carried, valves, wellhead, charge pump (typically a centrifugal pump), conveyers, and other equipment at the site of a hydraulic fracturing operation or other types of hydrocarbon recovery operations.

The features of the present invention which are believed to be novel are set forth below with particularity in the appended claims. However, modifications, variations, and changes to the exemplary embodiments described above will be apparent to those skilled in the art, and the universal monitoring device and method described herein thus encompasses such modifications, variations, and changes and are not limited to the specific embodiments described herein.

What is claimed is:

1. A universal monitoring system applicable to a variety of hydraulic fracturing equipment, comprising:

an accelerometer mounted on a pump housing of a positive displacement pump and configured to sense a vibration associated with the positive displacement pump on start-up and generate a wake-up signal;

a processor communicatively coupled to the accelerometer, and configured to initiate execution upon receiving the wake-up signal;

a pressure strain gauge mounted directly on the pump housing and configured to sense, in response to the initiated execution of the processor due to the wake-up signal, deformity in the pump housing caused by alternating high and low pressures within the pump housing during operations and generate sensor data;

the processor configured to receive the sensor data from the pressure strain gauge and configured to analyze the sensor data and determine a cycle count value, based on the received sensor data from the pressure strain gauge, for the positive displacement pump; and at least one communication interface, coupled to the processor, configured to transmit the sensor data and cycle count value to another device.

2. The system of claim 1, wherein the at least one communication interface includes a wireless communication interface selected from the group consisting of WiFi, Bluetooth, ZigBee, Z-Wave, NFC, RFID, and IR.

3. The system of claim 1, further comprising a test port in communication with the processor.

4. A universal monitoring system applicable to a variety of hydraulic fracturing equipment, comprising:

at least one sensor mounted on a housing of the hydraulic fracturing equipment and configured to measure a particular aspect of the hydraulic fracturing equipment during operations and generate sensor data based on the measured particular aspect of the equipment, the at least one sensor being an accelerometer, a strain gauge, a pressure sensor, a vibration sensor, a piezoelectric element, a proximity sensor, a linear variable displacement transducer, or a load cell;

a processor configured to:

receive the sensor data including a wake-up signal from the accelerometer, analyze the sensor data, interpret the sensor data as including the wake-up signal indicative of sensing start-up operation of the hydraulic fracturing equipment and including data indicative of a cycle count, and determine a cycle count value for the hydraulic fracturing equipment based on the generated sensor data; and at least one wireless communication interface coupled to the processor configured to wirelessly transmit the sensor data and cycle count value to another device.

5. The system of claim 4, wherein the at least one wireless communication interface is selected from the group consisting of WiFi, Bluetooth, ZigBee, Z-Wave, NFC, RFID, and IR.

6. The system of claim 4, further comprising a flow meter.

7. The system of claim 4, wherein the equipment is selected from the group consisting of a positive displacement pump, a slurry blender, a fracturing fluid tank, a high-pressure pipe, a high-pressure conduit, a charge pump, a trailer, a valve, a wellhead, and a conveyer.

8. The system of claim 4, wherein the at least one sensor is mounted to at least one of an interior or exterior surface of the housing of a fluid end of a positive displacement pump.

9. The system of claim 4, wherein the at least one sensor is mounted to at least one of an interior or exterior surface of the housing of a power end of a positive displacement pump.

10. A universal monitoring method applicable to a variety of hydraulic fracturing equipment, comprising:

sensing a vibration in a pump housing associated with a positive displacement pump on start-up and generating a wake-up signal;

initiating, in response to the wake-up signal, operation of a sensor mounted on a pump housing of the positive displacement pump;

sensing, by the sensor, deformity in the pump housing caused by alternating high and low pressures within the pump housing during pump operations and generating sensor data based on the sensed deformity caused by alternating high and low pressures;

analyzing the sensor data and determining a cycle count value for the positive displacement pump based on the sensor data; and storing the sensor data and cycle count value.

11. The method of claim 10, further comprising wirelessly transmitting the sensor data and cycle count value to another device.

12. The method of claim 10, wherein sensing, by the sensor, deformity in the pump housing comprises sensing, by a strain gauge, deformity in the pump housing.

13. The method of claim 10, further comprising sensing, by a fluid pressure sensor, pressure of fluids within the pump housing.

14. The method of claim 10, further comprising sensing, by a piezoelectric sensor, deformation in the pump housing.

15. The method of claim 10, further comprising sensing, by a proximity sensor, displacement of a portion of the pump housing.

* * * * *